US010576758B2

(12) United States Patent
Nakahata et al.

(10) Patent No.: US 10,576,758 B2
(45) Date of Patent: Mar. 3, 2020

(54) MEDIUM FEEDING DEVICE

(71) Applicant: SEIKO EPSON CORPORATION, Tokyo (JP)

(72) Inventors: Akinobu Nakahata, Nagano (JP); Takamasa Ikagawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/118,601

(22) Filed: Aug. 31, 2018

(65) Prior Publication Data

US 2019/0070869 A1 Mar. 7, 2019

(30) Foreign Application Priority Data

Sep. 4, 2017 (JP) ..... 2017-169566

(51) Int. Cl.
*B41J 11/00* (2006.01)
*B65H 1/04* (2006.01)

(52) U.S. Cl.
CPC ..... *B41J 11/0045* (2013.01); *B65H 1/04* (2013.01); *B65H 2402/5151* (2013.01); *B65H 2405/111* (2013.01); *B65H 2405/324* (2013.01); *B65H 2407/21* (2013.01); *B65H 2601/122* (2013.01); *B65H 2801/06* (2013.01)

(58) Field of Classification Search
CPC .... B41J 11/0045; B65H 1/04; B65H 2801/06; B65H 2601/122; B65H 2405/324; B65H 2405/111; B65H 2402/5151; B65H 2407/02
See application file for complete search history.

(56) References Cited

U.S. PATENT DOCUMENTS

2005/0062218 A1 3/2005 Murakami et al.

FOREIGN PATENT DOCUMENTS

| | | | |
|---|---|---|---|
| JP | 06-009067 | A | 1/1994 |
| JP | 07-097070 | A | 4/1995 |
| JP | 2005-075546 | A | 3/2005 |
| JP | 2009-046293 | A | 3/2009 |
| JP | 2009-073573 | A | 4/2009 |
| JP | 2009-073574 | A | 4/2009 |
| JP | 2011-195294 | A | 10/2011 |
| JP | 2016-222374 | A | 12/2016 |

OTHER PUBLICATIONS

IP.com search (Year: 2019).*

* cited by examiner

*Primary Examiner* — Lisa Solomon
(74) *Attorney, Agent, or Firm* — Global IP Counselors, LLP

(57) ABSTRACT

A manual paper feeding portion includes a medium placing portion on which paper to be fed is placed, a guide portion that is provided on the medium placing portion, guides a side edge of the paper in a width direction intersecting with a feeding direction, and is movable in the width direction, and a positioning mechanism that determines a position of the guide portion in the width direction, in which the positioning mechanism regulates the position of the guide portion by positioning portions arranged with a predetermined interval in a first region of a moving region of the guide portion and regulates the position of the guide portion in a stepless manner in a second region which is a region other than the first region.

9 Claims, 15 Drawing Sheets

MEDIUM FEEDING DEVICE

CROSS REFERENCES TO RELATED APPLICATIONS

The entire disclosure of Japanese Patent Application No. 2017-169566, filed Sep. 4, 2017 is expressly incorporated by reference herein.

BACKGROUND

1. Technical Field

The present disclosure relates to a medium feeding device including an edge guide which is provided to be movable corresponding to a size of a medium.

2. Related Art

In a medium feeding device which is provided in a recording apparatus representing an ink jet printer or in an image reading apparatus representing a scanner and feeds a medium such as recording paper or an original document, an edge guide which guides a side edge in a width direction of the medium is provided in a medium placing portion where a medium to be fed is set, and the edge guide is configured to be slidably moved in the width direction with respect to a placing surface of the medium placing portion corresponding to a size of the medium.

Such a medium feeding device includes a locking mechanism that locks the edge guide at a position corresponding to a width of a medium having a predetermined size (for example, JP-A-2009-73574).

In JP-A-2009-73574, a position at which an edge guide 100 is locked is determined when a bottom plate side first locking tooth portion 41 and a bottom plate side second locking tooth portion 42, which are provided in a bottom plate 20 (corresponding to medium placing portion) to which the edge guide 100 slides, are respectively engaged with a movable piece side first locking tooth portion 141 and a movable piece side second locking tooth portion 142, which are provided in the edge guide 100.

However, as disclosed in JP-A-2009-73574, in a configuration in which a position of the edge guide is determined by engagement of the medium placing portion side tooth portion with the edge guide side tooth portion, an accuracy of the position determination of the edge guide is determined by a pitch (interval between tooth and tooth) between the medium placing portion side tooth portions (bottom plate side first locking tooth portion 41 and bottom plate side second locking tooth portion 42).

Therefore, even when the edge guide is regulated at the closest position to a width of the medium corresponding to the size of the medium, a slight gap may be generated between the edge guide and a side edge of the medium.

Here, in the medium feeding device, when the medium set in the medium placing portion is fed by a feeding portion such as a feeding roller, inclination (also referred to as screwing) at which the medium is inclined and fed may be generated. The inclination can be suppressed if the side edge of the medium is appropriately guided by the edge guide.

On the contrary, if there is a gap between the edge guide and the side edge of the medium, there is a concern that the inclination of the medium is generated.

In the configuration in which the position of the edge guide is determined by the engagement of the medium placing portion side tooth portions and the edge guide side tooth portions, a pitch of the medium placing portion side tooth portions is generally set to a pitch at a degree at which the gap between the edge guide and the side edge of the medium in a case in which the edge guide is regulated at the closest position to the width of the medium does not influence on inclination of the medium at the time of being fed.

However, the gap between the edge guide and the side edge of the medium has a great influence on the inclination as the width of the medium to be fed becomes narrow. It is because that there are many cases that a length of the medium is usually shortened as the width of the medium becomes narrow. Even when the gap between the edge guide and the side edge of the medium in each case are same as another, there is a possibility that an angle of inclination increases as the length of the medium is shortened. Therefore, in a case in which the pitch of the medium placing portion side tooth portions is set to a predetermined interval, inclination with respect to a medium having a wide width is not generated, but inclination with respect to a medium having a narrow width may be generated.

Meanwhile, if the pitch of the medium placing portion side tooth portions is set to be small, an accuracy of position determination of the edge guide increases so that a problem of the inclination with respect to the medium having a narrow width to be generated can be solved to some, but the medium placing portion side tooth portions are difficult to be formed as the pitch decreases.

SUMMARY

An advantage of some aspects of the disclosure is to provide a medium feeding device which is simply configured and is capable of reliably determining an appropriate position of an edge guide corresponding to a size of a medium.

According to an aspect of the disclosure, there is provided a medium feeding device including a medium placing portion on which a medium to be fed is placed, a guide portion that is provided on the medium placing portion, guides a side edge of the medium in a width direction intersecting with a feeding direction of the medium, and is movable in the width direction, and a positioning mechanism that determines a position of the guide portion in the width direction, in which the positioning mechanism regulates the position of the guide portion by positioning portions arranged with a predetermined interval in a first region of a moving region of the guide portion and regulates the position of the guide portion in a stepless manner in a second region which is a region other than the first region.

In the medium feeding device, since the positioning mechanism that determines the position of the guide portion in the width direction regulates the position of the guide portion by the positioning portion disposed with the predetermined interval in the first region, and regulates the position of the guide portion in a stepless manner in the second region which is a region other than the first region, in the moving region of the guide portion, an accuracy of the position determination of the guide portion corresponding to the size of the medium can be changed. Therefore, an appropriate position of the guide portion can be determined corresponding to a size of a medium.

In addition, for example, since the position of the guide portion is regulated in a stepless manner in a region (second region) which requires a high accuracy of the position determination, and the position of the guide portion is regulated by the positioning portion disposed with predetermined intervals in the other region (first region) which does not require a high accuracy of the position determination compared to the second region, the positioning mechanism can be simply configured more than a case in which an accuracy of the position determination in the entire moving region of the guide portion increases.

In the medium feeding device, the positioning mechanism may include a protruding portion that is provided on a side of the guide portion, a plurality of recessed portions, as the positioning portions, that is provided with the predetermined interval on a part corresponding to the first region in the medium placing portion and regulates the position of the guide portion by receiving the protruding portion, and a friction member that is provided on a part corresponding to the second region in the medium placing portion and regulates the position of the guide portion by frictional resistance between the protruding portion and the friction member.

In this case, this configuration of the medium feeding device can be realized.

In the medium feeding device, a height of an opening edge of the recessed portion and a height of a contact surface of the friction member with the protruding portion may be the same as each other.

When the height of the contact surface of the friction member with the protruding portion is higher than a height of the opening edge of the recessed portion, there is a concern that the guide portion comes into contact with the friction member so as to be a resistance at the time of moving the guide portion. When the height of the contact surface of the friction member with the protruding portion is lower than a height of the opening edge of the recessed portion, a holding property of the protruding portion on the contact surface of the friction member decreases. According to the medium feeding device, since the height of the opening edge of the recessed portion and the height of the contact surface of the friction member with the protruding portion are the same as each other, both a good movability of the guide portion in the width direction and the holding property of the protruding portion on the contact surface of the friction member can be achieved.

Also, the "same" heights means not only a case in which the heights are strictly same as each other, but also, for example, a case in which the heights are almost the same as each other due to a difference of a range of tolerance.

According to another aspect of the disclosure, there is provided a medium feeding device including a medium placing portion on which a medium to be fed is placed, a guide portion that is provided on the medium placing portion, guides a side edge of the medium in a width direction intersecting with a feeding direction of the medium, and is movable in the width direction, and a positioning mechanism that determines a position of the guide portion in the width direction, in which the positioning mechanism regulates the position of the guide portion by first positioning portions arranged with a first interval in a first region of a moving region of the guide portion and regulates the position of the guide portion by a second positioning portion disposed with a second interval narrower than the first interval in a second region which is a region other than the first region.

In this case, since the positioning mechanism that determines the position of the guide portion in the width direction regulates the position of the guide portion by the first positioning portion disposed with the first interval in the first region, and regulates the position of the guide portion by the second positioning portion disposed with the second interval narrower than the first interval in the second region which is a region other than the first region, in the moving region of the guide portion, an accuracy of the position determination of the guide portion corresponding to the size of the medium can be changed. Therefore, an appropriate position of the guide portion can be determined corresponding to a size of the medium.

In the medium feeding device, the positioning mechanism may include a protruding portion that is provided on a side of the guide portion, a plurality of first recessed portions, as the first positioning portions, that is provided with first intervals on a part corresponding to the first region in the medium placing portion and regulates the position of the guide portion by receiving the protruding portion, and a plurality of second recessed portions, as the second positioning portions, that is provided with second intervals on a part corresponding to the second region in the medium placing portion and regulates the position of the guide portion by receiving the protruding portion.

In this case, this configuration of the medium feeding device can be realized.

In the medium feeding device, the protruding portion may be configured to be displaceable between a contact state in which the protruding portion comes into contact with the recessed portion and the friction member or the first recessed portion and the second recessed portion and a separated state in which the protruding portion is separated from the recessed portion and the friction member or the first recessed portion and the second recessed portion, and may be pressed in the contact state.

In this case, the guide portion can be reliably held at the determined position.

In the medium feeding device, the second region may be disposed in an inside of the first region in the width direction of the medium.

As the width of the medium decreases, an accuracy of the position determination of the guide portion easily influences on generation of inclination of the medium.

In this case, since the second region is disposed in the inside of the first region in the width direction of the medium, an accuracy of the position determination in a case in which a position of the side edge of the medium having a narrow width is regulated is high, and thus generation of inclination of the medium when being fed can be suppressed.

In the medium feeding device, the second region may be a region where the guide portion regulates the position of the side edge of a medium having a postcard size or less in the width direction.

In this case, an accuracy of position determination in a case in which the guide portion regulates a position of a side edge of a medium having a postcard size or less in a width direction is high, generation of inclination of the medium having a postcard size or less when being fed can be suppressed.

In the medium feeding device, the moving region of the guide portion may include an outside first region which is a first region provided to the outside of the medium in the width direction, an inside first region which is a first region provided in the inside of the medium in the width direction, and a second region which is provided between the outside first region and the inside first region, and the second region is a region where the position of the side edge of a medium having at least a postcard size in the width direction is regulated.

In this case, since a region where the position of the side edge in the width direction of the medium having at least a postcard size is regulated is set to the second region where an accuracy of the position determination of the guide portion is high, generation of inclination of the medium having a postcard size when being fed can be more reliably suppressed.

According to still another example of the disclosure, there is provided a recording apparatus including the medium feeding device according to the configuration, and a recording portion that performs recording on a medium to be fed from the medium feeding device.

In this case, in a recording apparatus including a recording portion that performs recording on the medium fed from the medium feeding device, an action effect the same as that of any one of the configurations described above can be obtained.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

First Embodiment

First, an outline of a recording apparatus according to an embodiment of the disclosure will be described. As an example of the recording apparatus of this example, an ink jet printer 1 (hereinafter, simply refer to as printer 1) is exemplified.

Figure 1:
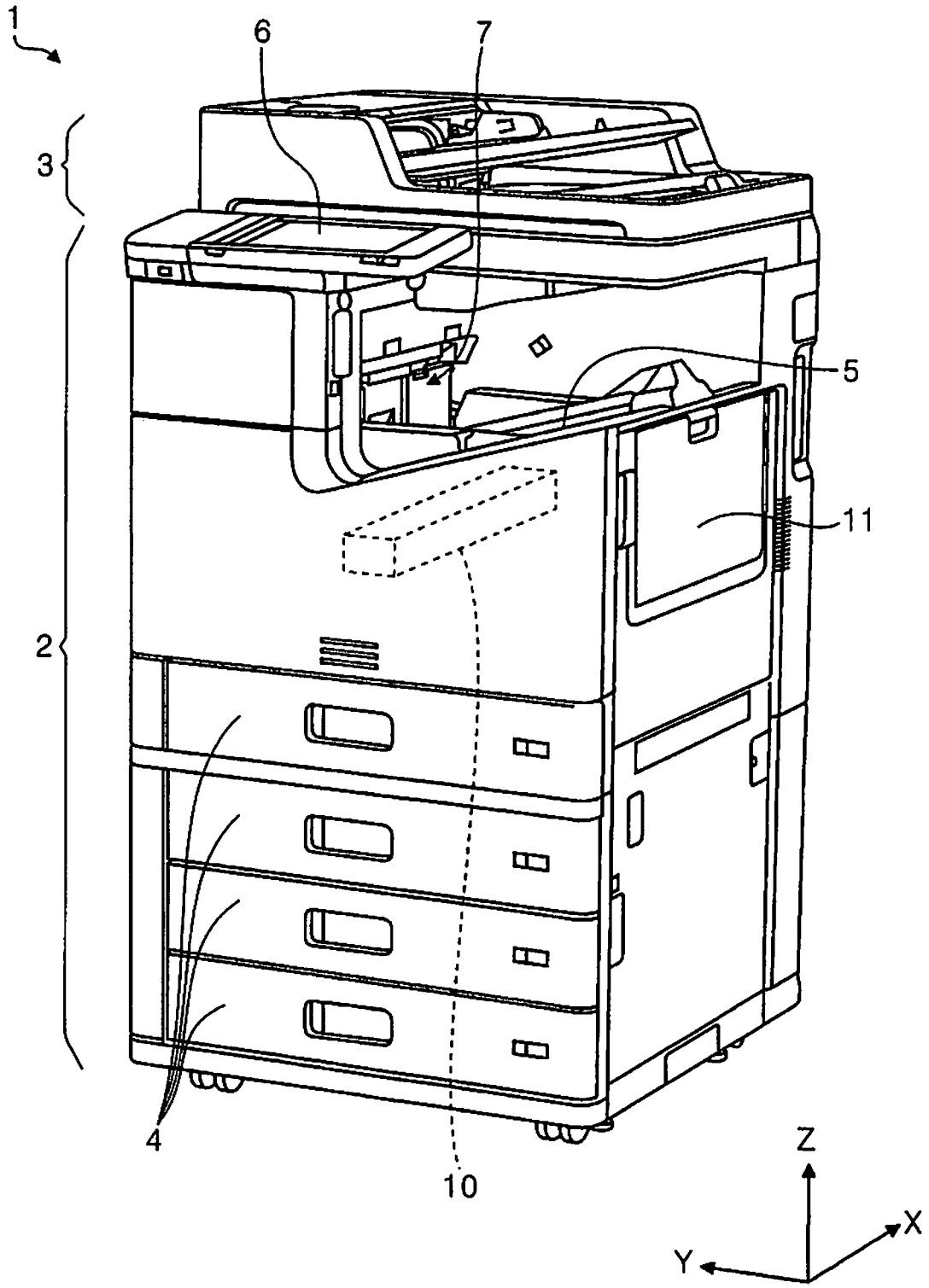
FIG. 1 is an external perspective view of a printer according to a first embodiment of the disclosure.
Figure 2:
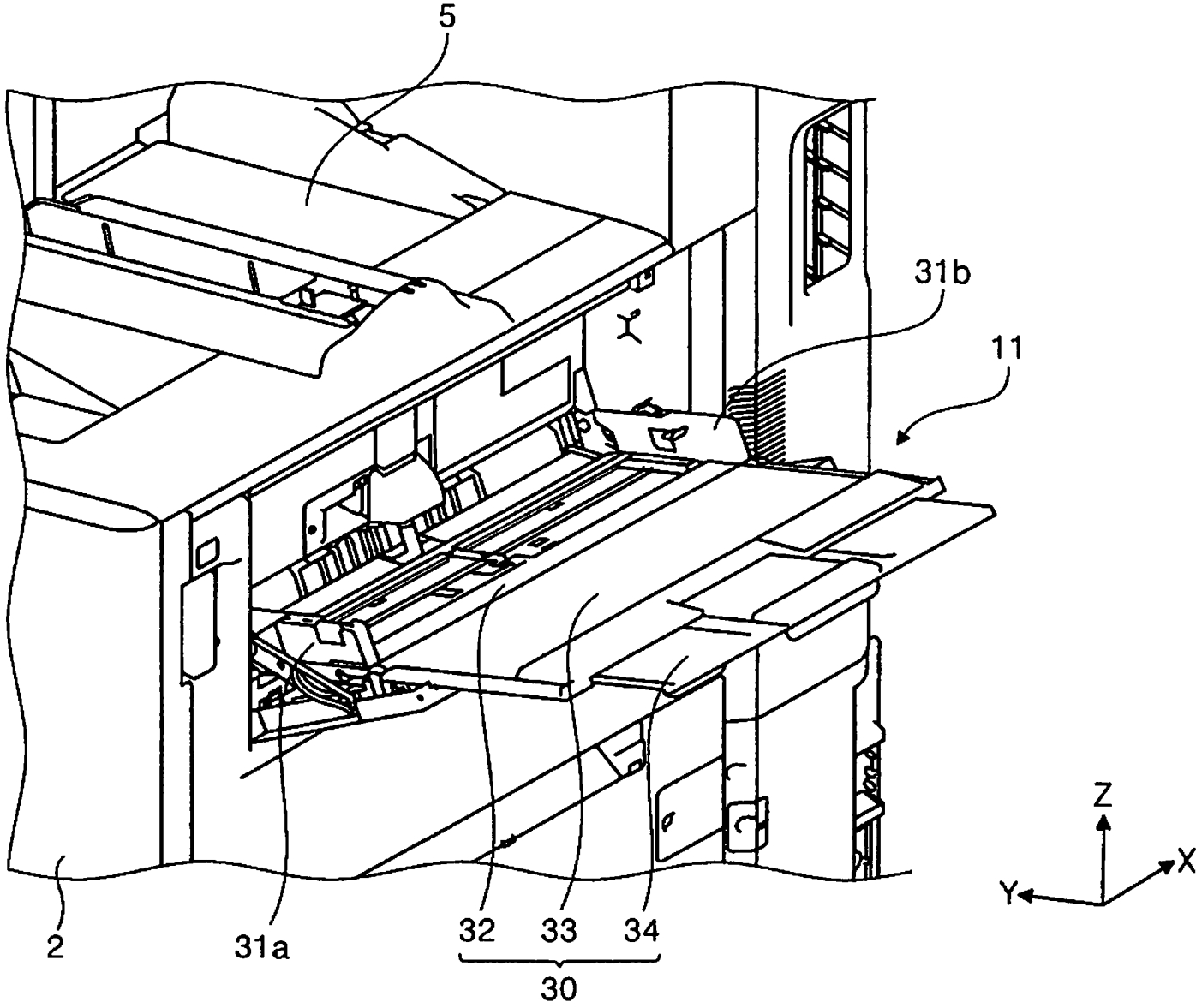
FIG. 2 is a perspective view illustrating a manual paper feeding portion in a developed state.
Figure 3:
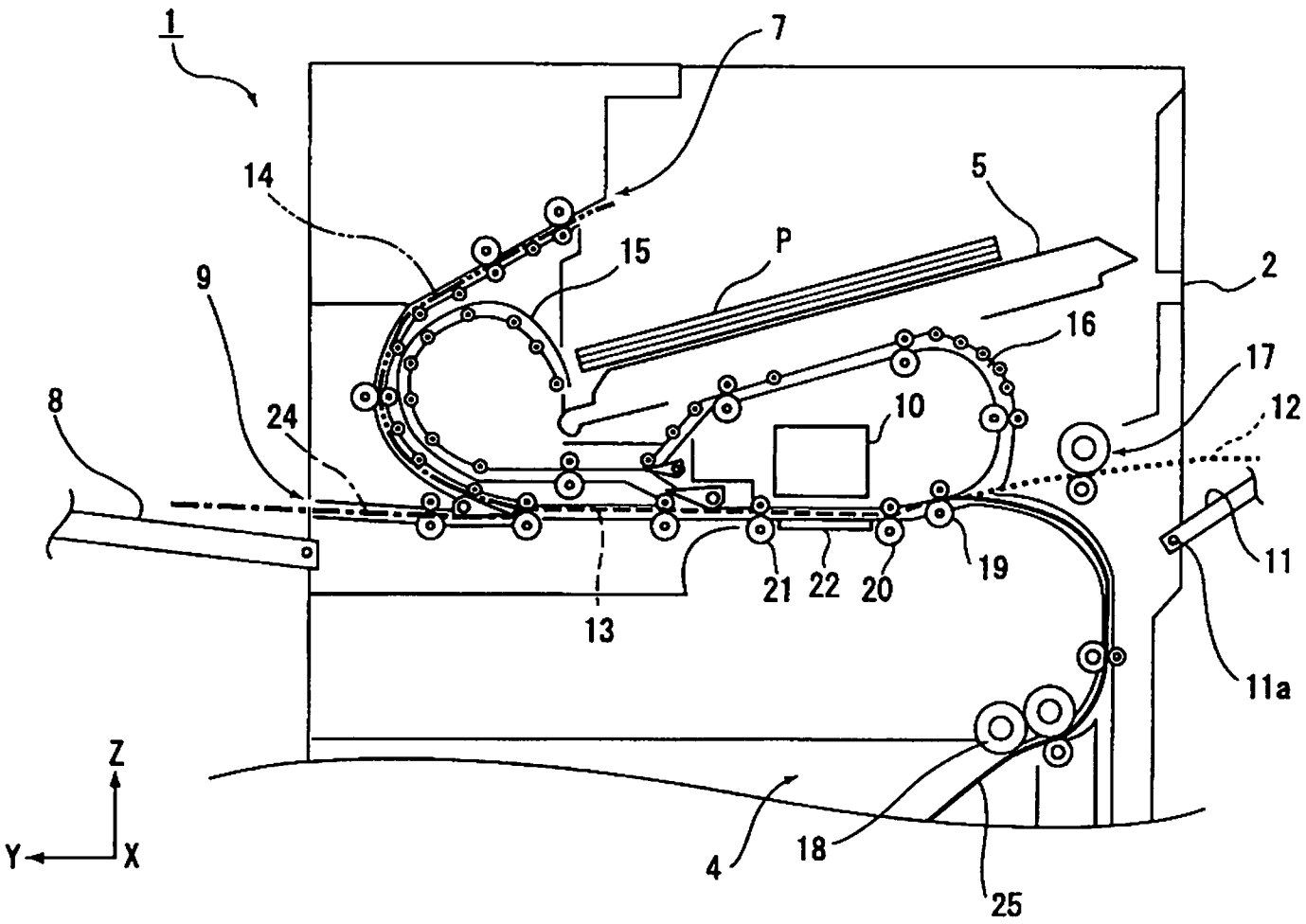
FIG. 3 is a schematic diagram illustrating a transportation path of paper in the printer.
Figure 4:
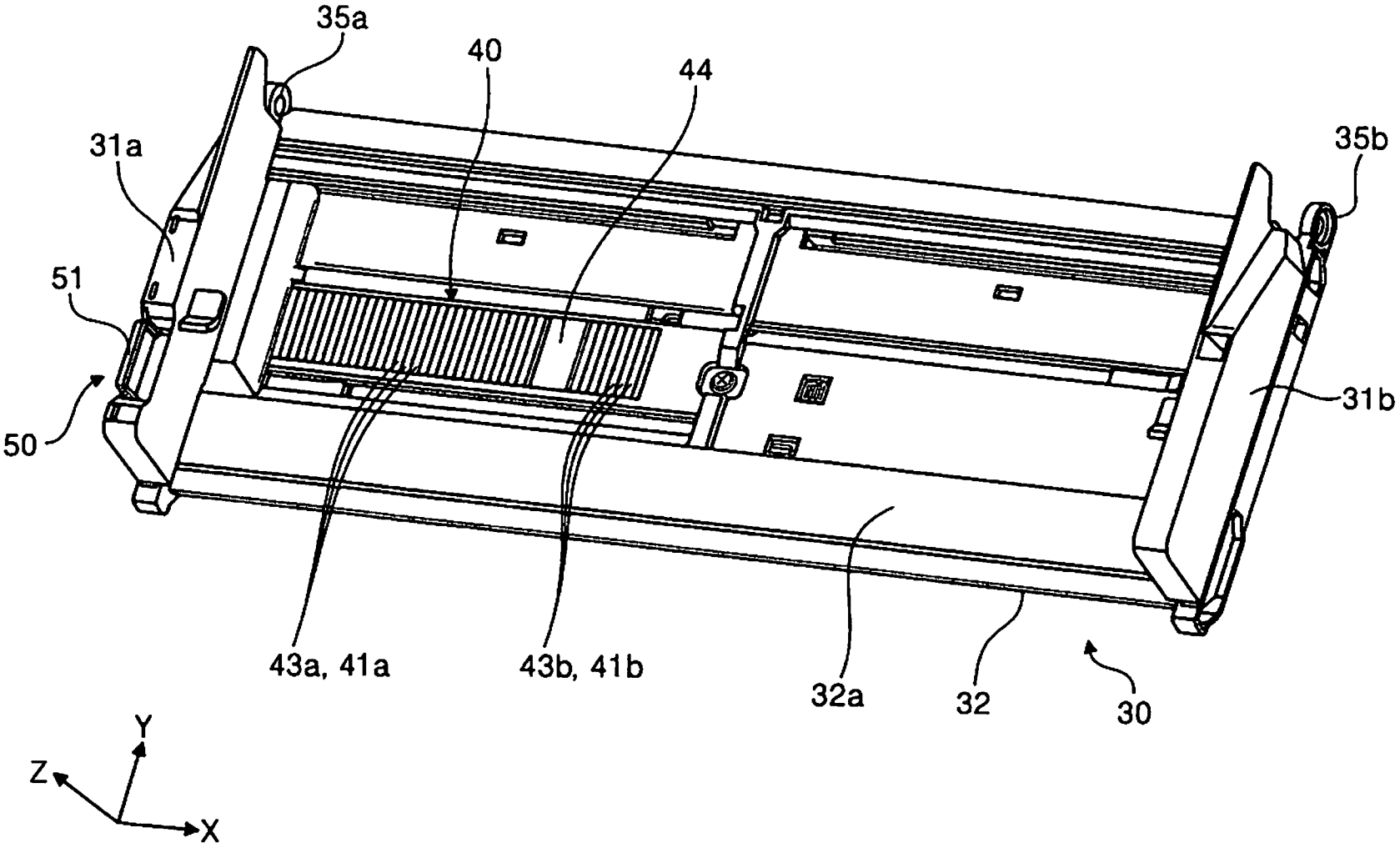
FIG. 4 is a perspective view illustrating a main part of a medium placing portion.
Figure 5:
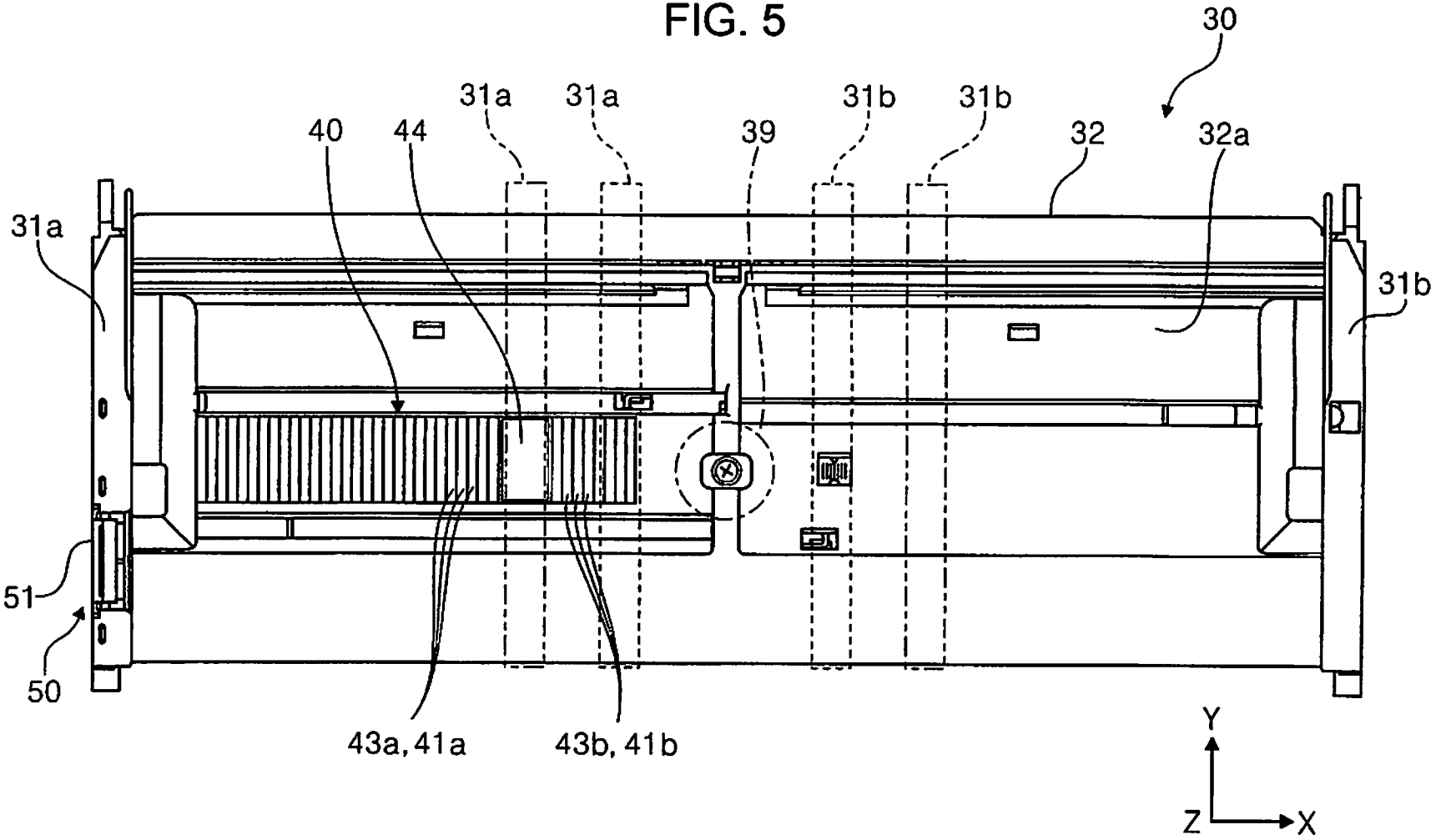
FIG. 5 is a plan view illustrating the main part of the medium placing portion.
Figure 6:
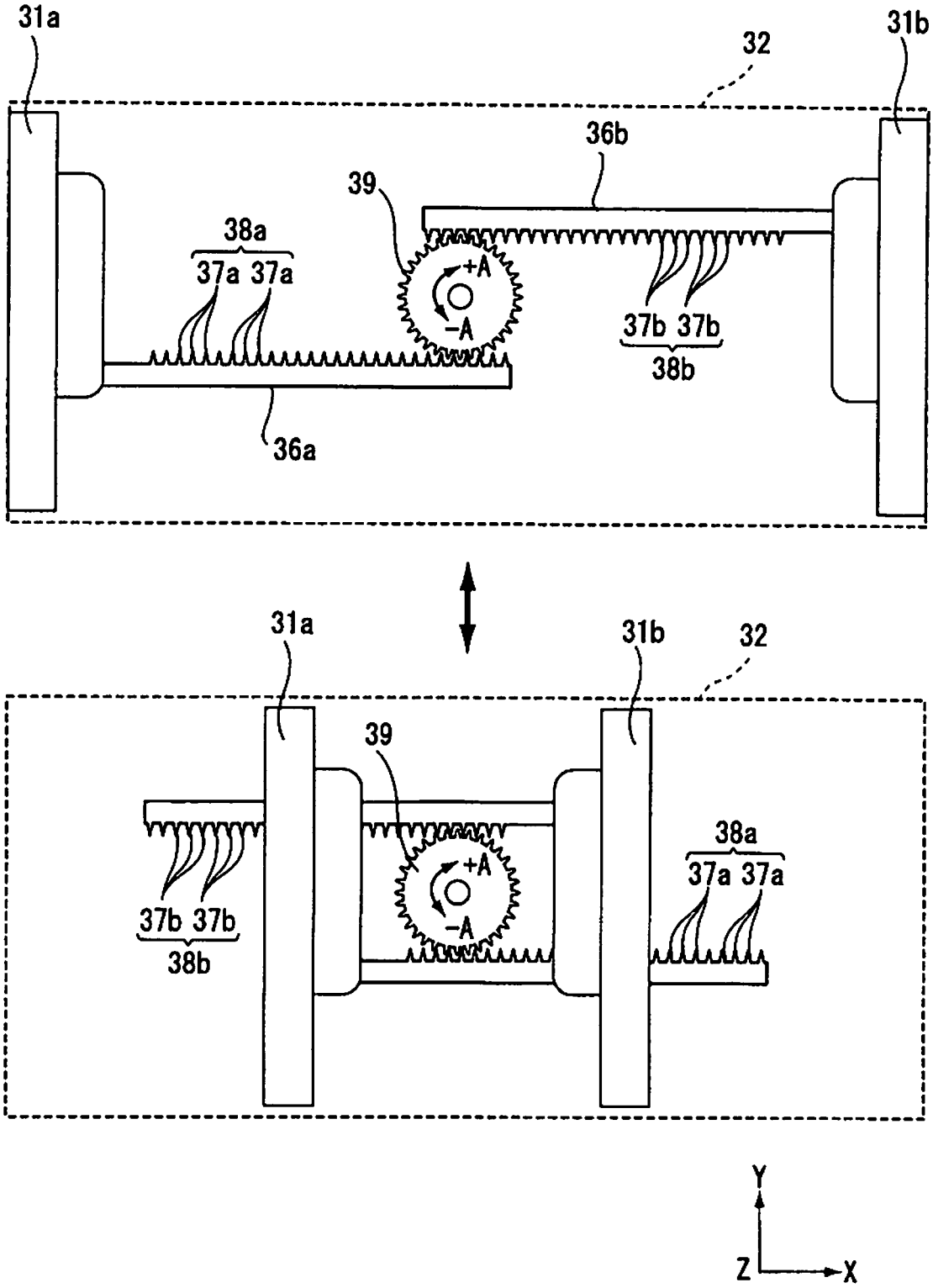
FIG. 6 is a view describing a moving mechanism in a guide portion.
Figure 7:
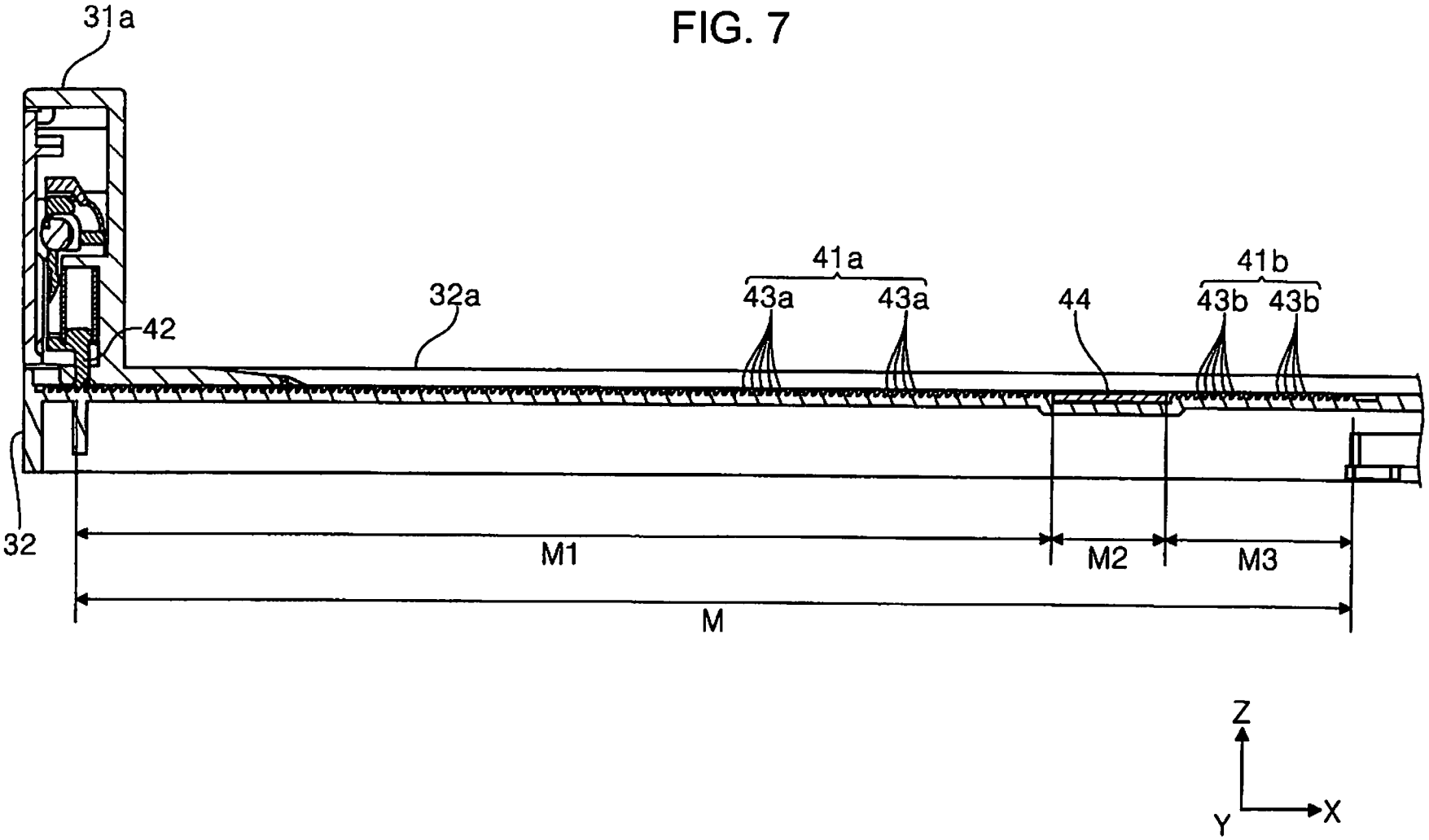
FIG. 7 is a sectional view illustrating a state in which the guide portion of a first placing portion is positioned in a first region.
Figure 8:
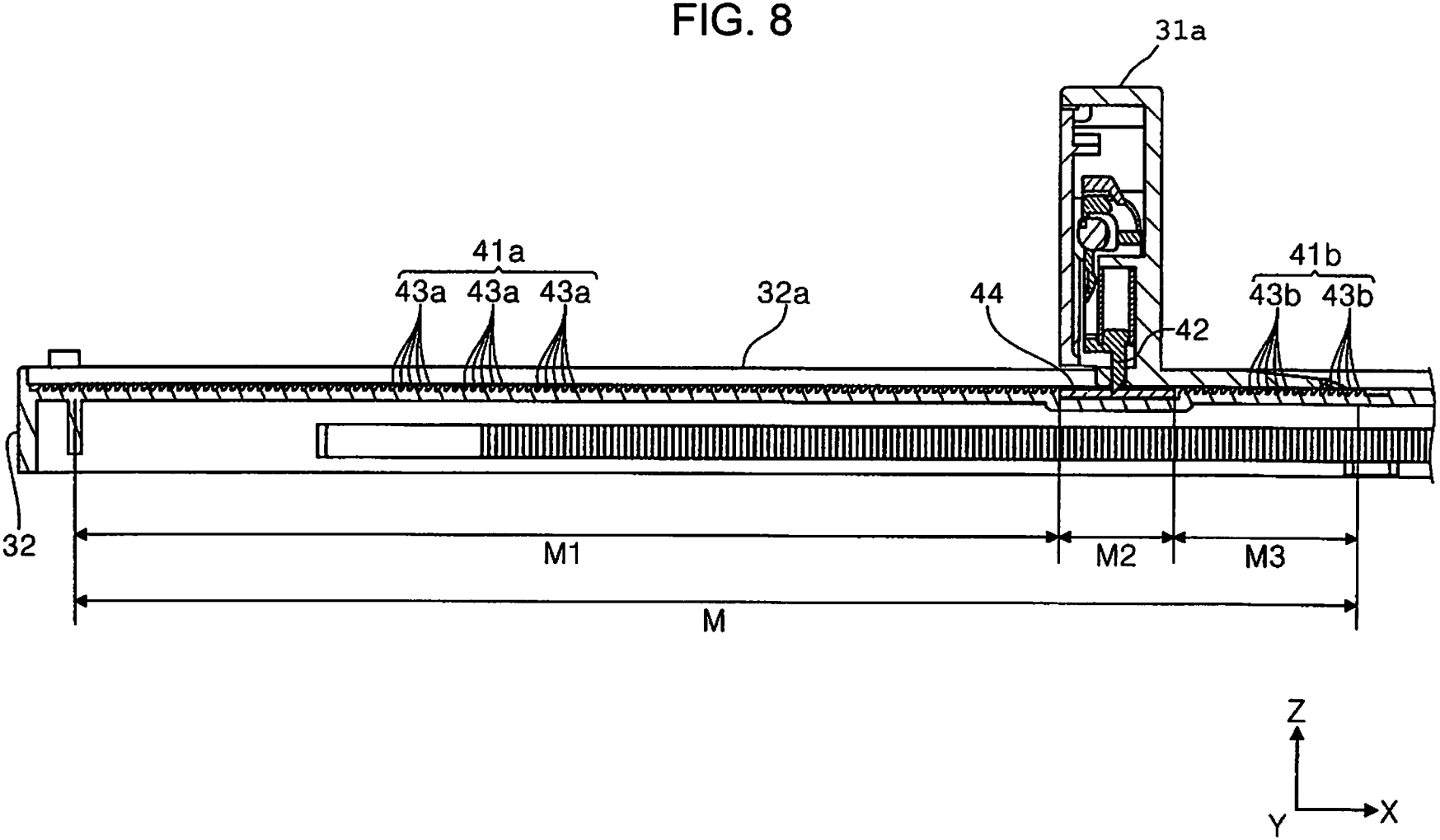
FIG. 8 is a sectional view illustrating a state in which the guide portion of the first placing portion is positioned in a second region.
Figure 9:
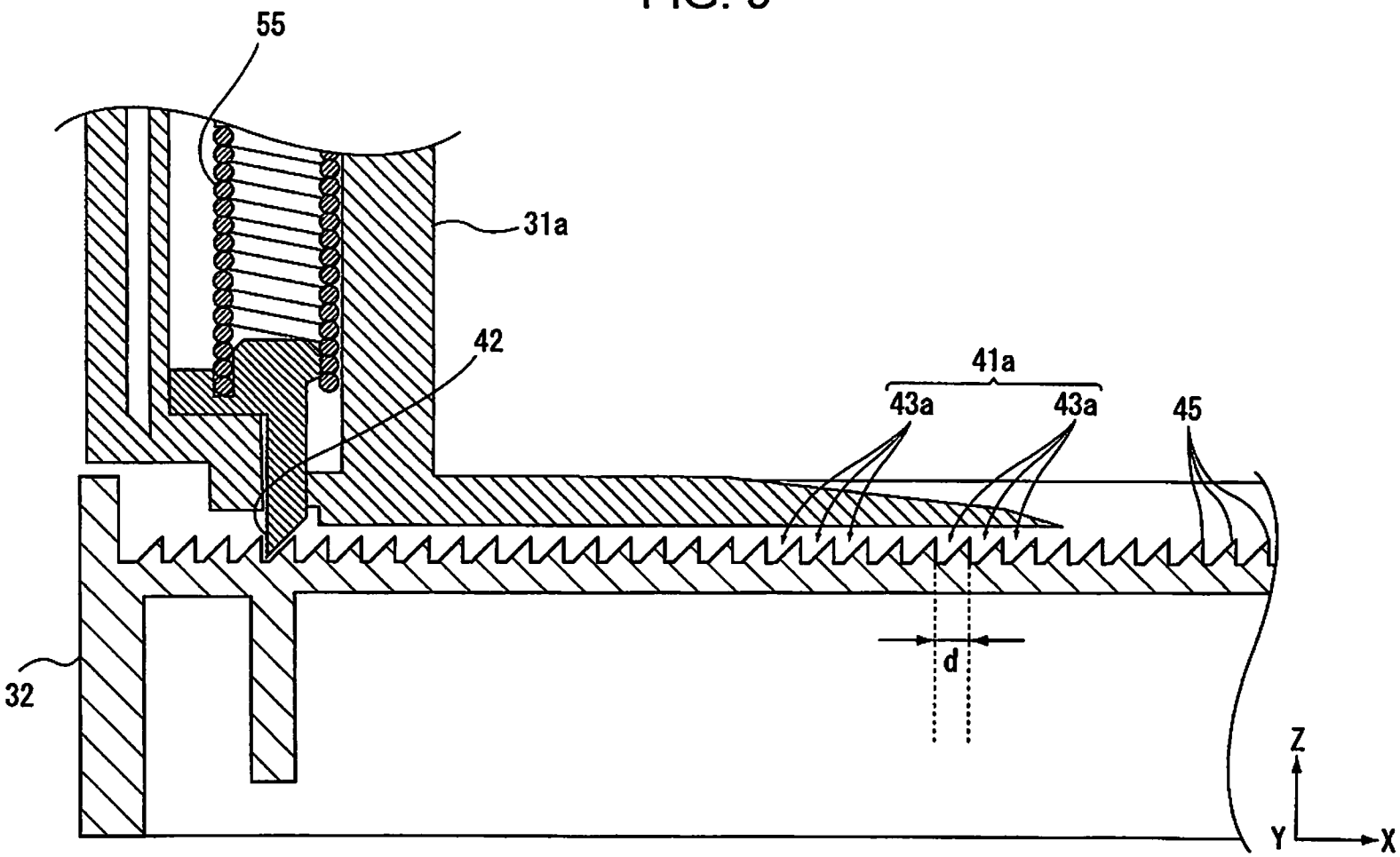
FIG. 9 is an enlarged view of the main part of FIG. 7.
Figure 10:
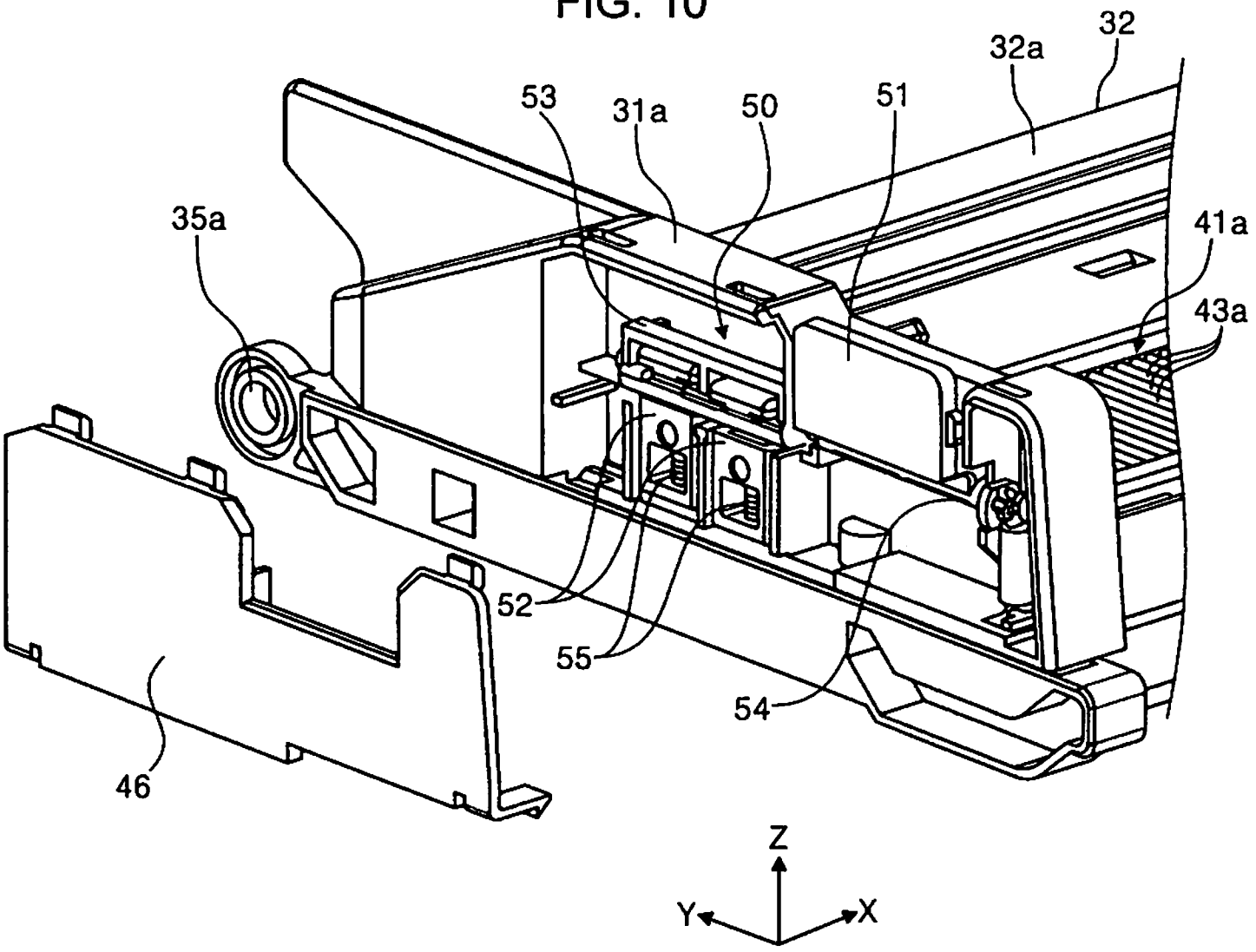
FIG. 10 is a perspective view illustrating a switching mechanism in a case in which a protruding portion is set in a contact state.
Figure 11:
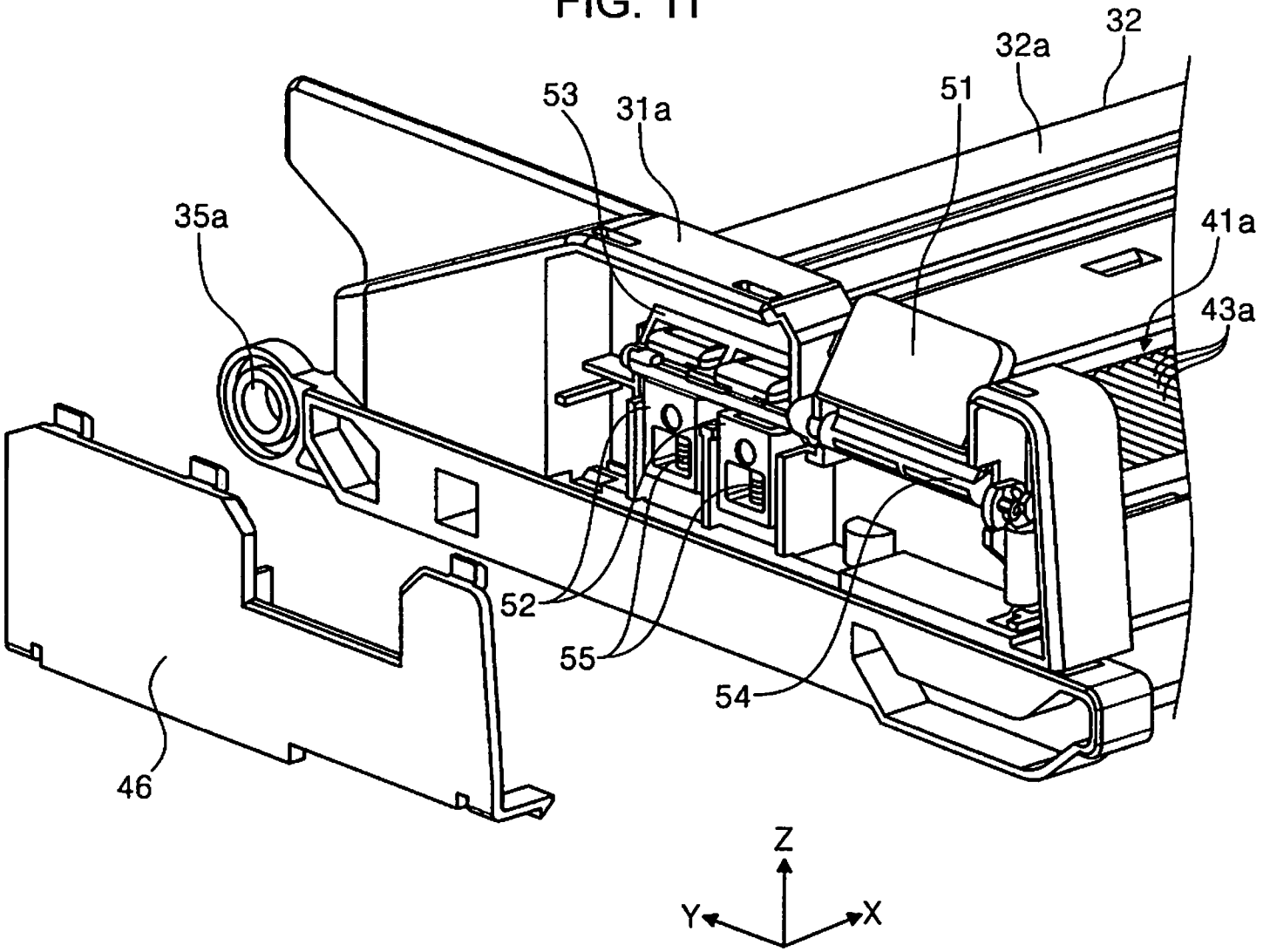
FIG. 11 is a perspective view illustrating the switching mechanism in a case in which the protruding portion is set in a separated state.
Figure 12:
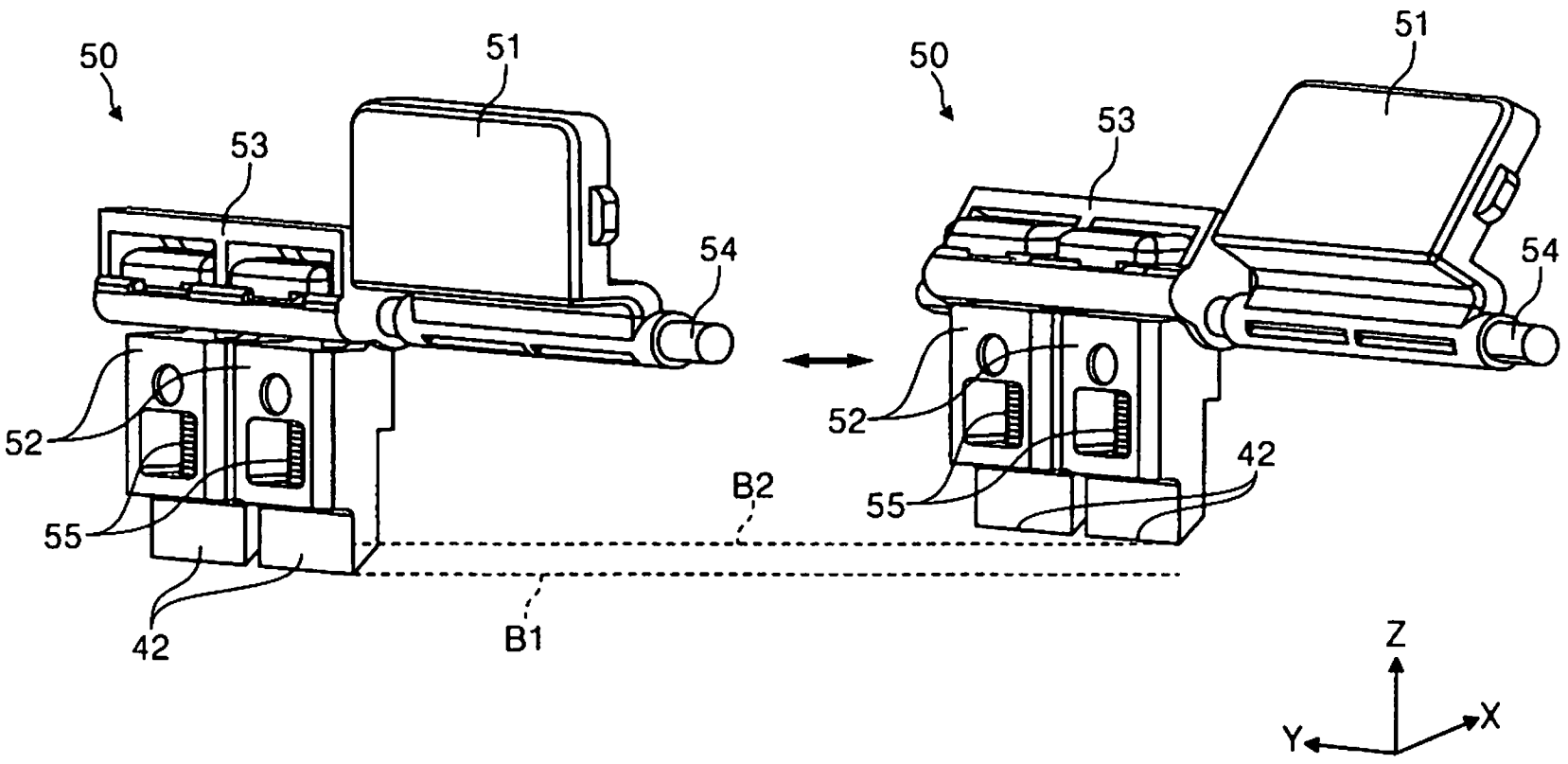
FIG. 12 is a view describing an operation of the switching mechanism.
Figure 13:
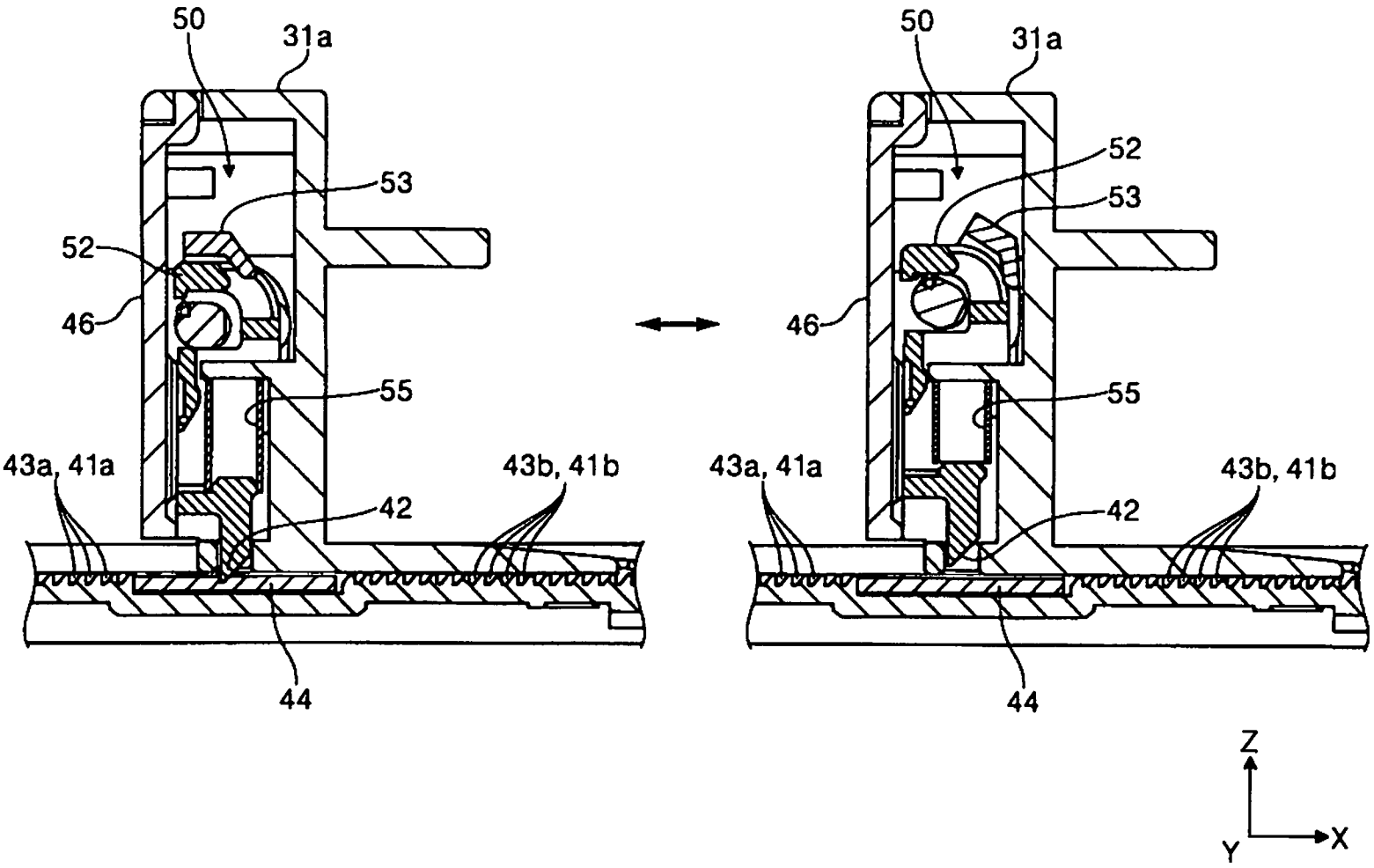
FIG. 13 is a view describing the operation of the switching mechanism.

FIG. 1 is an external perspective view of the printer according to the example of the disclosure. FIG. 2 is a perspective view illustrating a manual paper feeding portion in a developed state. FIG. 3 is a schematic diagram illustrating a transportation path of paper in the printer. FIG. 4 is a perspective view illustrating a main part of a medium placing portion. FIG. 5 is a plan view illustrating the main part of the medium placing portion. FIG. 6 is a view describing a moving mechanism of a guide portion. FIG. 7 is a sectional view illustrating a state in which the guide portion of a first placing portion is positioned in a first region. FIG. 8 a sectional view illustrating a state in which the guide portion of the first placing portion is positioned in a second region. FIG. 9 is an enlarged view of the main part of FIG. 7. FIG. 10 is a perspective view illustrating a switching mechanism in a case in which a protruding portion is set in a contact state. FIG. 11 is a perspective view illustrating a switching mechanism in a case in which the protruding portion is set in a separated state. FIGS. 12 and 13 are views describing an operation of the switching mechanism.

Regarding an X-Y-Z coordinate system illustrated in each drawing, an X direction indicates a width direction of a recording medium in a transportation path in the recording apparatus, a Y direction indicates a transporting direction of the recording medium, and a Z direction indicates a height direction of the apparatus. In each drawing, a −X direction is set to a front surface side of the apparatus, and a +X direction side is set to a rear surface side of the apparatus.

Outline of Printer

Hereinafter, the printer 1 will be mainly described with reference to FIG. 1.

The printer 1 is configured as a complex machine including a recording unit 2 that includes a line head 10 as a "recording portion" which performs recording on paper therein, and a scanner unit 3 that reads an original document. The recording unit 2 includes a plurality of paper accommodating cassettes 4 which accommodates a bundle of paper. Each paper accommodating cassette 4 is detachably attached to a front surface side (−X axis direction side in FIG. 1) of the recording unit 2. Moreover, in this specification, the paper as a "medium" means paper such as plain paper, cardboard, or photo paper.

The paper accommodated in the paper accommodating cassette 4 is transported to the line head 10, and a recording operation is performed. In the embodiment, the paper recorded by the line head 10 is discharged from either of a first discharging portion 7 for stacking paper P (FIG. 3) on a first paper discharging tray 5 provided on the line head 10 and a second discharging portion 9 (FIG. 3) for stacking the paper on a second paper discharging tray 8 (FIG. 3) provided on a side surface of a +Y direction side of the recording unit 2.

The recording unit 2 is configured to be capable of feeding paper from the manual paper feeding portion 11 (also refer to FIGS. 2 and 3) as a "medium feeding device", in addition to a case in which recording is performed by feeding the paper accommodated in the paper accommodating cassette 4. In other words, the line head 10 is capable of performing recording on the paper fed from the manual paper feeding portion 11.

The manual paper feeding portion 11 is provided on a side surface of a −Y direction side of the recording unit 2, and may become a stored state of being stored integrally with the side surface as illustrated in FIG. 1 or become a developed state in which the manual paper feeding portion is opened as illustrated in FIG. 2 and the medium placing portion where paper is placed appears. The manual paper feeding portion 11 opens and closes by being rotated around a rotating shaft 11*a* (FIG. 3) as a shaft, and is displaced between the stored state and the developed state. Also, a more specific configuration of the manual paper feeding portion 11 will be described later.

In addition, an operation panel 6 is provided on a front surface side of the recording unit 2. A display unit such as a liquid crystal panel is provided in the operation panel 6. In addition, instructions of a recording operation and an image reading operation can be input to the printer 1 by operating the operation panel 6.

Regarding Transportation Path of Printer

Next, with reference to FIG. 3, a transportation path of paper from the manual paper feeding portion 11 in the printer 1 will be described.

In FIG. 3, a dotted line illustrated by a reference number 12 is a first feeding path 12 which is a feeding path in a case in which paper is fed from the manual paper feeding portion 11. The paper set in the manual paper feeding portion 11 is fed by a first feeding roller 17 and is entered to a straight path 13 (illustrated by broken line) from the first feeding path 12.

A resist roller 19 is provided on a downstream side of the first feeding roller 17 in a transporting direction. In the embodiment, the first feeding path 12 and the straight path 13 are connected to each other at a position of the resist roller 19.

The straight path 13 is configured as a path extending in a substantially straight line shape, and a pair of upstream side transporting rollers 20, the line head 10, and a pair of downstream side transporting rollers 21 are formed on a downstream side of the resist roller 19. A recording region by the line head 10 is included in the straight path 13.

A supporting portion 22 which supports paper from an opposite side of a recording surface thereof is disposed on a region facing a head surface of the line head 10.

The line head 10 is configured to perform recording by ejecting ink (liquid) to a recording surface of paper after the paper is transported to the recording region facing the line head 10 on the supporting portion 22. The line head 10 is a recording head provided to cover the entire width of the paper with nozzles which eject ink, and is configured as a recording head capable of performing recording on the entire width of a medium without being moved in a medium width direction of the medium.

Also, the printer 1 of the example includes the line head 10, but may include a serial type recording head which is mounted in a carriage and performs recording by ejecting liquid to a medium while reciprocating in a direction intersecting with a transporting direction of the medium.

Subsequently, the paper on which recording is performed by the line head 10 is transported to either of a first discharging path 14 (illustrated by two-dot chain line in FIG. 3) and a second discharging path 24 (illustrated by long and short dash line in FIG. 3) from the straight path 13 according to a discharging destination of the recorded paper.

The first discharging path 14 is a curved path connected to the straight path 13 on a downstream side of the line head 10, and is a path where the paper is fed to be discharged from the first discharging portion 7 with a recording surface of the paper down.

The second discharging path 24 is a path extending in a substantially straight line shape from the straight path 13 on a downstream side of the line head 10, and is a path where the paper is fed to be discharged from the second discharging portion 9 with the recording surface of the paper up.

The first discharging path 14 and the second discharging path 24 are provided to be branched from the straight path 13 on a downstream side of the pair of downstream side transporting rollers 21.

The paper fed from the straight path 13 to the first discharging path 14 is discharged from the first discharging portion 7 and is placed on the first paper discharging tray 5 with the recording surface of the paper down.

In addition, the paper fed from the straight path 13 to the second discharging path 24 is discharged from the second discharging portion 9 and is placed on the second paper discharging tray 8 with the recording surface of the paper up.

Also, the paper accommodated in the paper accommodating cassette 4 is picked up by a second feeding roller 18 and is transported to a second feeding path 25 (illustrated by solid line in FIG. 3). The second feeding path 25 joins the straight path 13 in front of the resist roller 19. Since a transportation path subsequent to the straight path 13 is the same as the transportation path of the paper fed from the manual paper feeding portion 11, description thereof will be omitted.

In addition, the printer 1 is capable of performing double-side recording in which recording is performed on a first surface and then the recording is performed on a second surface which is a rear surface thereof. The paper in which the recording is performed on the first surface is reversed through a switch-back path 15 and a reverse path 16.

Regarding Manual Paper Feeding Portion

Hereinafter, a configuration of the manual paper feeding portion 11 (medium feeding device) which is a main part of the disclosure will be described.

The manual paper feeding portion 11 illustrated in FIG. 2 includes the medium placing portion 30 on which paper to be fed is placed and guide portions 31*a* and 31*b* which are provided on the medium placing portion 30 and guide a side edge of the paper in a width direction (X axis direction) intersecting with a feeding direction (+Y direction) of the paper.

The medium placing portion 30 illustrated in FIG. 2 includes the guide portions 31*a* and 31*b* provided therein and also includes a first placing portion 32 (also refer to FIGS. 4 and 5) including bearing portions 35*a* and 35*b* (FIG. 4) receiving the rotating shaft 11*a* (FIG. 3) provided on a main body of the recording unit 2, a second placing portion 33 which supports the paper on an upstream side of the first placing portion 32, and a third placing portion 34 which is provided to be stored in the second placing portion 33 and can be taken out. The third placing portion 34 is configured to be taken out corresponding to a length (size of medium in transporting direction) of the paper being set in the medium placing portion 30. In addition, when the manual paper feeding portion 11 is set in the stored state (FIG. 1), the third placing portion 34 is stored in the second placing portion 33.

The guide portions 31*a* and 31*b* are provided to slide and be movable in the X axis direction corresponding to a width size of the paper with respect to an upper surface of the first placing portion 32. In the example, the guide portions 31*a* and 31*b* follow movement of one guide portion 31*a* in the X axis direction, and moves in a direction opposite to the other guide portion 31*b*.

That is, in the medium placing portion 30, the paper is provided to the center in a width direction, and is configured to feed paper in a called center paper feeding method.

Also, in FIG. 5, positions of the guide portions 31*a* and 31*b* illustrated by a solid line is a position corresponding to a side edge of the paper having a maximum width size at which the paper can be placed on the medium placing portion 30, positions of the guide portions 31*a* and 31*b* illustrated by a dotted line is a position corresponding to the side edge of the paper having a minimum width size at which the paper can be placed on the medium placing portion 30, and positions of the guide portions 31*a* and 31*b* illustrated by a two-dot chain line is a position corresponding to the side edge of the paper having a postcard width size.

Regarding Moving Mechanism of Guide Portion

Hereinafter, with reference to FIG. 6, the guide portion 31*a* and the guide portion 31*b* will be described.

As a moving mechanism of the guide portion 31*a* and the guide portion 31*b*, an arm portion 36*a* in which one end side extending in the X axis direction is provided in the guide portion 31*a*, and an arm portion 36*b* in which one end side extending in the X axis direction is provided in the guide portion 31*b*, a rack portion 38*a* constituted by a plurality of teeth 37*a* provided in the arm portion 36*a*, and a rack portion 38*b* constituted by a plurality of teeth 37*b* provided in the arm portion 36*b*, and a pinion teeth wheel 39 which is rotatably attached to the center of the first placing portion 32 in the width direction are included. The rack portion 38*a* and the rack portion 38*b* are engaged with the pinion teeth wheel 39 as illustrated in an upper drawing of FIG. 6.

Also, in FIG. 6, the first placing portion 32 is illustrated by a dotted line. The moving mechanism (arm portions 36*a* and 36*b*, rack portions 38*a* and 38*b*, and pinion teeth wheel 39) of the guide portion 31*a* and the guide portion 31*b* is actually disposed on a lower surface (−Z direction side) of the first placing portion 32.

In the upper drawing of FIG. 6, the guide portions 31*a* and 31*b* are disposed at a position corresponding to a width direction of the paper having a maximum size at which the paper can be set in the medium placing portion 30, that is, are disposed on the outermost side. In a state of the upper drawing of FIG. 6, when the guide portion 31*a* is moved from the outside to the inside in the width direction, that is, when the guide portion is moved in the +X direction, the arm portion 36*a* is also moved in the +X direction, and thus the pinion teeth wheel 39 engaged with the rack portion 38*a* is rotated in a −A direction of directions illustrated by a double-head arrow.

When the pinion teeth wheel 39 is rotated in the −A direction, the arm portion 36*b* including the rack portion 38*b* engaged with the pinion teeth wheel 39 is moved in the −X direction. Therefore, the guide portion 31*b* is also moved in the −x direction. Intervals between the plurality of teeth 37*a* and intervals between the plurality of teeth 37*b* are set to be the same as each other, and when the guide portion 31*a* is moved to the inside in the width direction of the paper, as illustrated in a lower drawing of FIG. 6, the guide portion 31*b* is also moved to the inside in the width direction of the paper in the same as that of the guide portion 31*a*.

Conversely, in a case in which the guide portion 31*a* is moved from the inside to the outside in the width direction, that is, the guide portion is moved in the −X direction, the pinion teeth wheel 39 is rotated in a +A direction, and the guide portion 31*b* is moved in the +X direction.

Positioning Mechanism of Guide Portion

Here, in order to appropriately match positions of the guide portion 31*a* and the guide portion 31*b* to a width size of the paper set in the medium placing portion 30, in the first placing portion 32, as illustrated in FIGS. 4 and 5, a positioning mechanism 40 which determines the positions of the guide portions 31*a* and 31*b* in the width direction is provided. In the embodiment, the positioning mechanism 40 is provided in a moving region M (FIG. 7) of the guide portion 31*a* which is one of the guide portions.

Also, the positioning mechanism 40 regulates the position of the guide portion 31*a* by a positioning portion 41*a* disposed with predetermined intervals d (FIG. 9) in a first region M1, and regulates the position of the guide portion 31*a* in a stepless manner in a second region M2 which is a region other than the first region M1, in the moving region M of the guide portion 31*a* illustrated in FIG. 7.

More specifically, as illustrated in FIGS. 7 and 9, the positioning mechanism 40 includes a protruding portion 42 provided on a guide portion 31*a* side, a plurality of recessed portions 43*a* as the positioning portion 41*a* which is provided with predetermined intervals d (FIG. 9) on a part corresponding to the first region M1 in the first placing portion 32 (medium placing portion 30) and regulate the position of the guide portion 31*a* receiving the protruding portion 42, and a friction member 44 which is provided on a part corresponding to the second region M2 in the first placing portion 32 (the medium placing portion 30) illustrated in FIG. 7 and regulates the position of the guide portion 31*a* due to a frictional resistance between the protruding portion 42 with the guide portion. As the friction member 44, an elastic member including the frictional resistance such as rubber, cork, or a resin material is used.

The position of the guide portion 31*a* in the first region M1 is determined, as illustrated in FIG. 7, by engaging the protruding portion 42 provided on the guide portion 31*a* side with the plurality of recessed portions 43*a* which is provided with a predetermined interval d (FIG. 9) on a first placing portion 32 side. Therefore, an accuracy of position determination in the first region M1 becomes an accuracy in accordance with the predetermined intervals d between the plurality of recessed portions 43*a*.

Meanwhile, since the position of the guide portion 31*a* in the second region M2 is determined by regulating the position of the guide portion 31*a* due to the frictional resistance between the friction member 44 and the protruding portion 42 as illustrated in FIG. 8, the position of the guide portion 31*a* can be regulated in a stepless manner. Therefore, an accuracy of the position determination in the second region M2 is higher than an accuracy of the position determination in the first region M1.

Also, in the guide portion 31*a*, a switching mechanism 50 which switches a locked state in which the guide portion 31*a* is locked at a position determined by the positioning mechanism 40 and a non-locked state in which the position of the guide portion 31*a* is provided to be free so as to be changed. The switching mechanism 50 will be described later.

In addition, in a further inside (+X direction side) of the second region M2, a first region M3 is provided. The first region M3 is an "inside first region" which is provided in the inside of the first region M1 in a case in which the first region M1 is set as an "outside first region" which is the first region provided on the outside in the width direction of the paper.

In other words, in the moving region M of the guide portion 31*a*, the second region M2 is provided between the first region M1 (outside first region) and the first region M3 (inside first region).

Also, the second region M2 is a region where a position of a side edge in the width direction of the paper having at least a postcard size is regulated.

A plurality of recessed portions 43*b* as a positioning portion 41*b* which is provided with predetermined intervals d in the same as that of the positioning portion 41*a* provided in the first region M1 and regulates the position of the guide portion 31*a* receiving the protruding portion 42 is provided in the first region M3 on the first placing portion 32 (medium placing portion 30).

The positioning mechanism 40 which determines the position of the guide portion 31*a* in the width direction includes a configuration described above, and thus action effects as follows can be obtained.

That is, since the positioning mechanism 40 regulates the position of the guide portion 31*a* by the positioning portion 41*a* (recessed portion 43*a*) and the positioning portion 41*b* (recessed portion 43*b*) which are disposed with predetermined intervals d in the first region M1 and the first region M3, and regulates the position of the guide portion 31*a* in a stepless manner when the friction member 44 is disposed in the second region M2 which is a region other than the first region M1 and the first region M3, in the moving region M of the guide portion 31*a*, an accuracy of position determination of the guide portion 31*a* can be changed corresponding to the size of the paper. Therefore, the position of the guide portion 31*a* can be appropriately determined corresponding to the size of the paper.

If the guide portion 31*a* is positioned on the outside of a position suitable for the size of the paper, the paper to be guided may be inclined. For example, in a case in which positions of a corner of a distal end of the paper on a +X side and a corner of a distal end of the paper on a −X side are inclined so as to be deviated by a predetermined amount (for example, 1 mm) in the Y axis direction, an angle of the inclined paper increases as the width of the paper becomes narrow. In addition, the paper tends to have a shorter length as the width becomes narrow. In a case in which a length of the paper is short, since a rear end side of the paper becomes in a state of being mostly deviated from guiding of the guide portions 31*a* and 31*b* as a distal end of the paper reaches the first feeding roller 17 illustrated in FIG. 3, it can be assumed that the angle of the inclination of the paper increases. That is, as the paper has a narrow width, an accuracy of the position determination of the guide portion 31*a* tends to easily influence on generation of the inclination of the paper.

In the embodiment, since the second region M2 with high accuracy of the position determination where the position can be determined in a stepless manner is a region where a position of the side edge in the width direction of the paper having at least a postcard size is regulated, generation of the inclination can be suppressed by increasing the accuracy of the position determination in a case in which the position of the side edge having a postcard size is regulated.

In addition, since the position of the guide portion 31*a* is regulated in a stepless manner in the second region M2 requiring a high accuracy of the position determination, and the position of the guide portion 31*a* is regulated by the positioning portion 41*a* disposed with predetermined intervals d in the first region M1 which is the other region not requiring a higher accuracy of the position determination than that of the second region M2, the positioning mechanism 40 can be formed with low costs and a simple configuration compared to a case in which the accuracy of the position determination in the entire moving region M of the guide portion 31*a* increases (for example, friction member is provided in the entire moving region M).

In addition, in the embodiment, the first region M3 is provided in the inside of the second region M2 in the width direction, but the first region M3 (the inside first region) cannot be provided. That is, in the moving region M of the guide portion 31*a*, the entire inside of the first region M1 in the width direction can be set as the second region M2. In other words, the second region M2 can be disposed in the inside in the width direction further than the first region M1.

The second region M2 is a region where the guide portion 31*a* regulates the position of the side edge of a medium having a size equal to or less than a postcard size in the width direction.

As seen from the above, an accuracy of the position determination in a case in which the guide portion 31*a* regulates the position of the side edge in the width direction of the paper having a postcard size or less increases, generation of inclination when the paper having a postcard size or less is fed can be suppressed.

Also, for example, particularly, in a case in which it is specialized that the paper having a postcard size is frequently used and an accuracy of the guide position with respect to the paper having a postcard size increases, if a configuration of FIG. 5 in which the first region M3 (inside first region) is provided is used, since a region where the friction member 44 is provided is reduced and a required friction member 44 is also reduced so that the regions are not enough, and thereby it is advantageous in regards of costs.

In addition, in the embodiment, a height of an opening edge 45 (FIG. 9) of the recessed portion 43*a* and a height of a contact surface of the friction member 44 with the protruding portion 42 are disposed to be the same as each other. An opening edge (not illustrated) of the recessed portion 43*b* also has the same height of the opening edge 45 of the recessed portion 43*a*.

If the height of the contact surface of the friction member 44 with the protruding portion 42 is higher than the height of the opening edge 45 of the recessed portion 43*a*, the guide portion 31*a* comes into contact with the friction member 44, and thus there is a concern that resistance is generated when the guide portion 31*a* is moved. If the height of the contact surface of the friction member 44 with the protruding portion 42 is lower than the height of the opening edge of the recessed portion 43*a*, a holding property of the protruding portion 42 on the contact surface of the friction member 44 decreases.

If the height of the opening edge 45 of the recessed portion 43*a* and the height of the contact surface of the friction member 44 are the same as each other, both a good mobility of the guide portion 31*a* in the width direction and the holding property of the protruding portion 42 on the contact surface of the friction member 44 can be achieved.

In addition, as illustrated in FIGS. 7 and 8, the recessed portion 43*a*, the recessed portion 43*b*, and the friction member 44 are positioned under a placing surface 32*a* which mainly supports the paper in the first placing portion 32. Accordingly, a concern that the opening edge 45 of the recessed portion 43*a*, the opening edge (no reference number given) of the recessed portion 43*b*, and the friction member 44 come into contact with the paper so as to become a transporting resistance of the paper can be reduced.

Regarding Switching Mechanism

As described above, in the guide portion 31*a*, the switching mechanism 50 (FIG. 4) which switches the locked state in which the guide portion 31*a* is locked at a position determined by the positioning mechanism 40 and the non-locked state in which the position of the guide portion 31*a* is provided to be free so as to be changed.

As illustrated in FIGS. 10 and 11, a part of the switching mechanism 50 is provided inside the guide portion 31*a*. FIGS. 10 and 11 illustrate a state in which an outer surface portion 46 constituting the guide portion 31*a* is removed.

The switching mechanism 50 (FIGS. 10 and 11) includes an operating portion 51 (also refer to FIG. 4) for being operated by a user, a displacement member 52 including the protruding portion 42 on a distal end thereof, and a holding portion 53 holding the displacement member 52. The operating portion 51 is attached to a shaft portion 54 connected to the holding portion 53.

As illustrated in FIG. 13, the displacement member 52 can be displaced between a contact state (left drawing of FIG. 13) in which the protruding portion 42 comes into contact with the recessed portions 43*a* and 43*b* and the friction member 44 and a separated state (right drawing of FIG. 13) in which the protruding portion is separated from the recessed portion 43*a* and the friction member 44, and is pressed in the contact state by a pressing member 55 such as a coil spring.

Also, the guide portion 31*a* is locked (in locked state) when the protruding portion 42 is in the contact state, and the guide portion 31*a* can be freely moved (in non-locked state) when the protruding portion 42 is in the separated state.

More specifically, as illustrated in left drawings of FIGS. 10 and 12, in a case in which the operating portion 51 is disposed toward a surface of the outer surface portion 46, the protruding portion 42 becomes in the contact state as illustrated in the left drawing of FIG. 13, that is, the guide portion 31*a* becomes in the locked state, as illustrated in right drawings of FIGS. 11 and 12, in a case in which the operating portion 51 is rotated in a clockwise direction when seen from the −Y direction side, the displacement member 52 is displaced upwardly, and the protruding portion 42 becomes in the separated state as illustrated in the right drawing of FIG. 13, that is, the guide portion 31*a* becomes in the non-locked state.

When the protruding portion 42 is fit into the recessed portions 43*a* and 43*b* and is pressed, the protruding portion 42 is reliably held by the recessed portions 43*a* and 43*b*. In addition, when the protruding portion 42 comes into contact with the friction member 44 and is pressed, the protruding portion 42 is pushed into the friction member 44 (formed of elastic member such as rubber or cork) so as to be reliably held. Therefore, the guide portion 31*a* can be reliably held at a determined position.

Also, in FIG. 12, a position B1 illustrated by a dotted line is a position of the protruding portion 42 in a Z axis direction in the contact state, and a position B2 illustrated by a dotted line is a position of the protruding portion 42 in the Z axis direction in the separated state.

Second Embodiment

Figure 14:
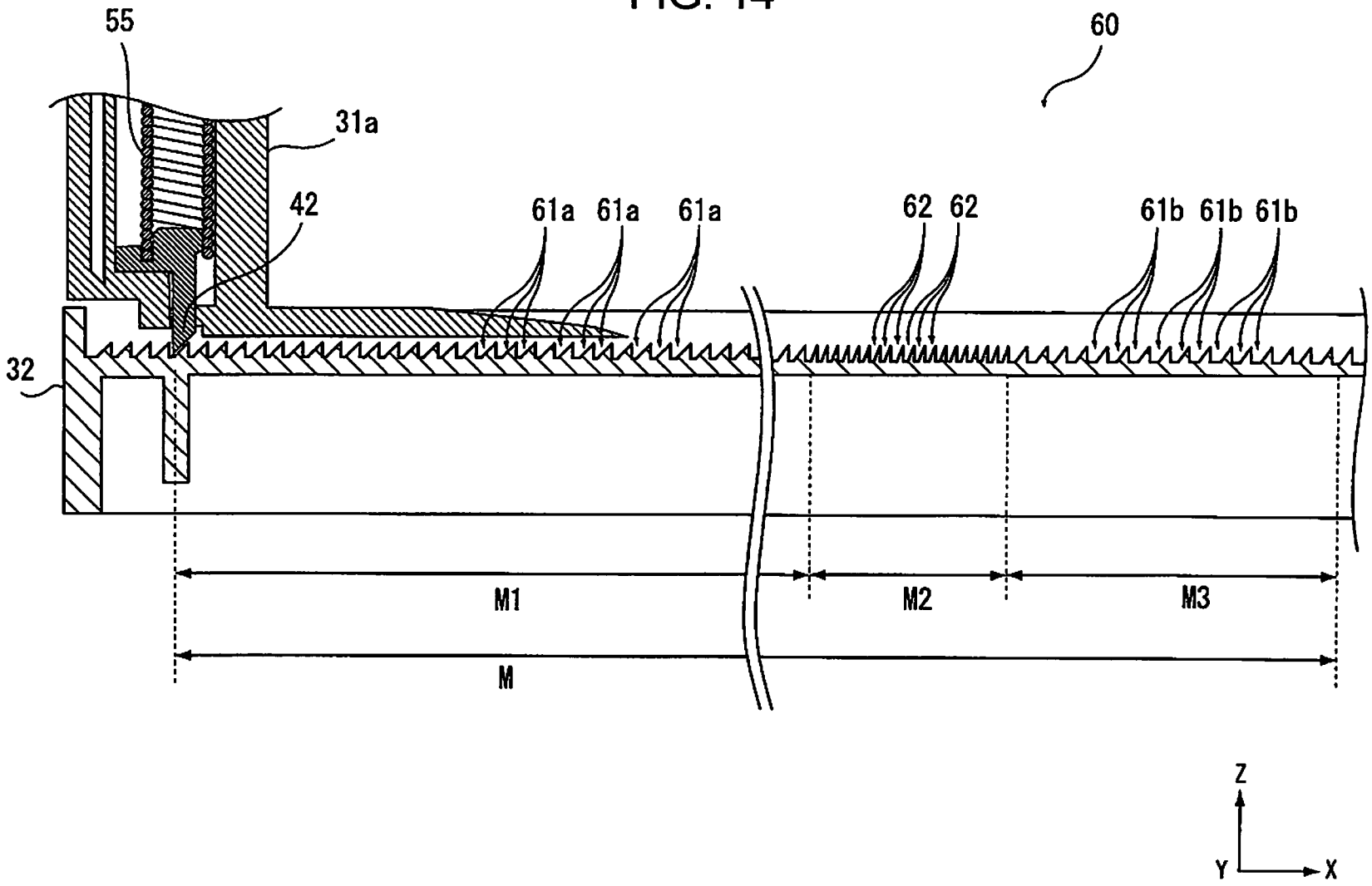
FIG. 14 is a view describing a positioning mechanism according to a second embodiment.

In a second embodiment, with reference to FIG. 14, another example of the positioning mechanism will be described. FIG. 14 is a view describing a positioning mechanism according to the second embodiment. In the embodiment, a reference number same as that of the first embodiment is given to a configuration same as that of the first embodiment, and description thereof will be omitted.

A positioning mechanism 60 illustrated in FIG. 14 regulates the position of the guide portion 31*a* by first recessed portions 61*a* and 61*b* as a "first positioning portion" disposed with a first interval d1 in the first regions M1 and M3 in the moving region M of the guide portion 31*a*, and regulates the position of the guide portion 31*a* by a second recessed portion 62 as a "second positioning portion" disposed with a second interval d2 which is narrower than the first interval d1 in the second region M2 which is a region other than the first regions M1 and M3.

The first recessed portions 61*a* and 61*b* and the second recessed portion 62 regulate the position of the guide portion 31*a* receiving the protruding portion 42 provided on the guide portion 31*a* side.

In the first embodiment, in the second region M2, the position of the guide portion 31*a* is regulated in a stepless manner by the friction member 44, but in this embodiment, the position of the guide portion 31*a* can be regulated by the second recessed portion 62 disposed with the second interval d2 in the second region M2 narrower than the first interval d1 in the first regions M1 and M3.

Since the second recessed portions 62 are provided with narrower intervals than the first recessed portions 61*a* and 61*b*, an accuracy of the position determination of the guide portion 31*a* in the second region M2 can be increased more than an accuracy of the position determination of the guide portion 31*a* in the first regions M1 and M3.

In addition, in the embodiment, the protruding portion 42 can be displaced between a contact state of coming into contact with the first recessed portions 61*a* and 61*b* and the second recessed portion 62 and a separated state of being separated from the first recessed portions 61*a* and 61*b* and the second recessed portion 62, and is pressed in the contact state by the pressing member 55. Therefore, the guide portion 31*a* can be reliably held at a determined position.

Third Embodiment

Figure 15:
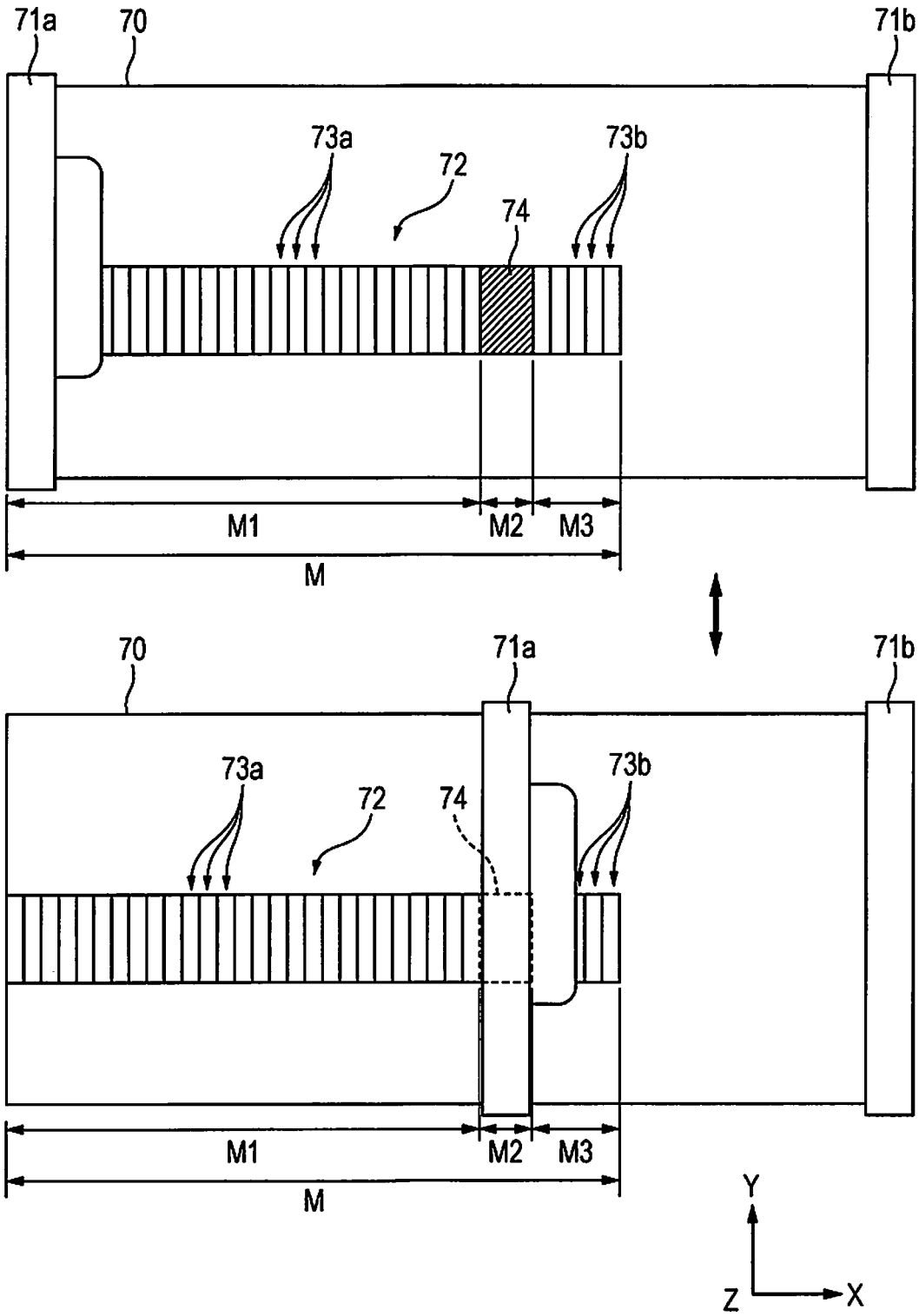
FIG. 15 is a view describing a medium placing portion according to a third embodiment.

In a third embodiment, with reference to FIG. 15, still another example of the medium placing portion constituting the manual paper feeding portion (medium feeding device)' will be described. FIG. 15 is a view describing a medium placing portion according to the third embodiment.

A medium placing portion 70 described in this embodiment includes a pair of guide portions 71*a* and 71*b* which guides the side edge in the width direction of the paper. In the guide portions 71*a* and 71*b*, so-called a biasing paper feeding method in which one guide portion 71*b* is fixed and the other guide portion 71*a* is only moved in the X axis direction is used.

An upper drawing of FIG. 15 illustrates a state in which the guide portion 71*a* is disposed at a position in accordance with the side edge of the paper having a maximum width size which can be placed on the medium placing portion 70, and a lower drawing of FIG. 15 illustrates a state in which the guide portion 71*a* is disposed at a position in accordance with the side edge of the paper having a postcard size.

In the medium placing portion 70, a positioning mechanism 72 configured to be the same as the positioning mechanism 40 in the first embodiment is provided with respect to the guide portion 71*a* to be moved.

The positioning mechanism 72 is provided in the moving region M (FIG. 7) of the guide portion 71*a*, and regulates the position of the guide portion 31*a* by a recessed portion 73*a* and a recessed portion 73*b* (positioning portion) disposed with predetermined intervals in the first region M1 and the first region M3, and regulates the position of the guide portion 31*a* in a stepless manner by the friction member 74 in the second region M2 which is a region between the first region M1 and the first region M3, in the moving region M. The second region M2 is a region where the position of the side edge in the width direction of the paper having at least a postcard size is regulated.

Also, the protruding portion (not illustrated) can be fit into the recessed portion 73*a* is provided on the guide portion 31*a* side.

With the configuration described above, effects the same as the effects described in the first embodiment can be obtained.

Also, in the positioning mechanism 72, in the same manner as the first embodiment, the friction member 74 is provided in the first region M3, the entire inside of the first region M1 in the width direction can be set to the second region M2. In addition, instead of the positioning mechanism 72, a positioning mechanism having the same configuration as the positioning mechanism 60 in the second embodiment can be provided.

Also, the configuration of the positioning mechanism of the guide portion described in each embodiment can be applied to, for example, a positioning mechanism that guides a rear end of the paper in the transporting direction and guides the rear end to be movable in a direction (Y axis direction) along the transporting direction corresponding to a size of paper.

In addition, a medium feeding device that feeds an original document to be read by an image reading apparatus represented by a scanner can be provided.

In addition, the disclosure is not limited to the embodiments described above, various modification can be made within a range of the disclosure disclosed in claims, and it is needless to say that modifications thereof are also included in the range of the disclosure.

What is claimed is:

1. A medium feeding device comprising:

a medium placing portion on which a medium to be fed is placed:

a guide portion that is provided on the medium placing portion, guides a side edge of the medium in a width direction intersecting with a feeding direction of the medium, and is movable in the width direction; and a positioning mechanism that determines a position of the guide portion in the width direction, wherein the positioning mechanism regulates the position of the guide portion by positioning portions arranged with a predetermined interval in a first region of a moving region of the guide portion and regulates the position of the guide portion in a stepless manner in a second region which is a region other than the first region, and wherein the positioning mechanism includes a protruding portion that is provided on a side of the guide portion, a plurality of recessed portions, as the positioning portions, that is provided with the predetermined interval on a part corresponding to the first region in the medium placing portion and regulates the position of the guide portion by receiving the protruding portion, and a friction member that is provided on a part corresponding to the second region in the medium placing portion and regulates the position of the guide portion by frictional resistance between the protruding portion and the friction member.

2. The medium feeding device according to claim 1, wherein a height of an opening edge of the recessed portion and a height of a contact surface of the friction member with the protruding portion are the same as each other.

3. A medium feeding device comprising:

a medium placing portion on which a medium to be fed is placed;

a guide portion that is provided on the medium placing portion, guides a side edge of the medium in a width direction intersecting with a feeding direction of the medium, and is movable in the width direction; and a positioning mechanism that determines a position of the guide portion in the width direction, wherein the positioning mechanism regulates the position of the guide portion by first positioning portions arranged with a first interval in a first region of a moving region of the guide portion and regulates the position of the guide portion by a second positioning portion disposed with a second interval narrower than the first interval in a second region which is a region other than the first region.

4. The medium feeding device according to claim 3, wherein the positioning mechanism includes a protruding portion that is provided on a side of the guide portion, a plurality of first recessed portions, as the first positioning portions, that is provided with the first interval on a part corresponding to the first region in the medium placing portion and regulates the position of the guide portion by receiving the protruding portion, and a plurality of second recessed portions, as the second positioning portions, that is provided with the second interval on a part corresponding to the second region in the medium placing portion and regulates the position of the guide portion by receiving the protruding portion.

5. The medium feeding device according to claim 1, wherein the protruding portion is configured to be displaceable between a contact state in which the protruding portion comes into contact with the recessed portion and the friction member or the first recessed portion and the second recessed portion and a separated state in which the protruding portion is separated from the recessed portion and the friction member or the first recessed portion and the second recessed portion, and is pressed in the contact state.

6. The medium feeding device according to claim 1, wherein the second region is disposed in an inside of the first region in the width direction of the medium.

7. The medium feeding device according to claim 6, wherein the second region is a region where the guide portion regulates the position of the side edge of a medium having a postcard size or less in the width direction.

8. A medium feeding device comprising:

a medium placing portion on which a medium to be fed is placed;

a guide portion that is provided on the medium placing portion, guides a side edge of the medium in a width direction intersecting with a feeding direction of the medium, and is movable in the width direction; and a positioning mechanism that determines a position of the guide portion in the width direction, wherein the positioning mechanism regulates the position of the guide portion by positioning portions arranged with a predetermined interval in a first region of a moving region of the guide portion and regulates the position of the guide portion in a stepless manner in a second region which is a region other than the first region, wherein the moving region of the guide portion includes an outside first region which is a first region provided to the outside of the medium in the width direction, an inside first region which is a first region provided in the inside of the medium in the width direction, and a second region which is provided between the outside first region and the inside first region, and wherein the second region is a region where the position of the side edge of a medium having at least a postcard size in the width direction is regulated.

9. A recording apparatus comprising:

the medium feeding device according to claim 1, and a recording portion that performs recording on a medium to be fed from the medium feeding device.

* * * * *